US006519784B2

(12) United States Patent
Carwile

(10) Patent No.: US 6,519,784 B2
(45) Date of Patent: Feb. 18, 2003

(54) WATER CLOSET SEAL APPARATUS

(76) Inventor: James Arthur Carwile, 812 E. Columbia, Boonville, IN (US) 47601

( * ) Notice: Subject to any disclaimer, the term of this patent is extended or adjusted under 35 U.S.C. 154(b) by 0 days.

(21) Appl. No.: 09/855,643

(22) Filed: May 11, 2001

(65) Prior Publication Data

US 2002/0166161 A1 Nov. 14, 2002

(51) Int. Cl.[7] ..... E03D 11/17
(52) U.S. Cl. ..... 4/252.5; 4/252.1; 4/252.6
(58) Field of Search ..... 4/252.1, 252.4, 4/252.5, 252.6

(56) References Cited

U.S. PATENT DOCUMENTS 807,265 A * 12/1905 Gutelius ..... 4/252.4
1,107,094 A * 8/1914 Mitchell ..... 4/252.1 X
2,427,431 A * 9/1947 Wieland ..... 4/252.5 X
4,090,267 A * 5/1978 Cuschera ..... 4/252.5
5,185,890 A * 2/1993 Dismore et al. ..... 4/252.5
5,291,619 A * 3/1994 Adorjan ..... 4/252.1 X

* cited by examiner

*Primary Examiner*—Robert M. Fetsuga
(74) *Attorney, Agent, or Firm*—C. Richard Martin

(57) ABSTRACT

The invention is a seal apparatus useful as a seal between a commode and a drain pipe comprising a pipe extension, a gasket, and a flanged base. The pipe extension comprises an extension sealing surface. The gasket comprises a sealing lip, a pipe extension clearance, and a gasket sealing surface. The flanged base comprisies a pipe bonding surface and a base sealing surface.

8 Claims, 9 Drawing Sheets

WATER CLOSET SEAL APPARATUS

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a seal apparatus for a commode. It is an alternate means of sealing as compared to the present means of using a wax ring as a seal.

2. Background Information

A current means of sealing the juncture of a commode with a drain pipe is a wax seal.

A shortcoming is that the wax seal is often not reusable. Replacement is often required if the commode is removed from the seal, which can happen for various reasons, such as floor refinishing.

The wax seal is also prone to damage.

As will be seen from the subsequent description, the preferred embodiments of the present invention overcome these and other shortcomings of prior art.

SUMMARY OF THE INVENTION

The present invention is a seal apparatus useful as a seal between a commode and a drain pipe comprising, in the preferred embodiment, a pipe extension, a gasket, a flanged base, and a cover plate.

The gasket comprises a sealing lip, a pipe extension clearance, and a gasket sealing surface.

The flanged base comprises inside and outside pipe bonding surfaces, a base sealing surface, a base drain, and a groove.

The flanged base is bondable to a drain pipe.

With the gasket placed in the flanged base, and with a commode with the pipe extension placed on the flanged base with the pipe extension inserted into the gasket, with the base sealing surface sealed by the sealing lip, a seal is enabled between the commode and the drain pipe.

The flanged base comprises an inside pipe bonding surface and an outside pipe bonding surface, each sized so that the flanged base can either be placed over, and be bondable to, or into, and be bondable to, the drain pipe. In the preferred embodiment of the present invention, the flanged base bonding surfaces are sized to permit the flanged base to be usable with either a 3 inch or a 4 inch schedule 40 drain pipe.

The vertical position of the pipe extension with respect to the gasket is variable, thereby permitting variations of heights of the commode with respect to the gasket.

The cover plate comprises an annular ring that engages the flanged base groove, retaining the cover plate in position over the flanged base, closing the base drain, as required.

DESCRIPTION OF THE PREFERRED EMBODIMENTS

Figure 1:
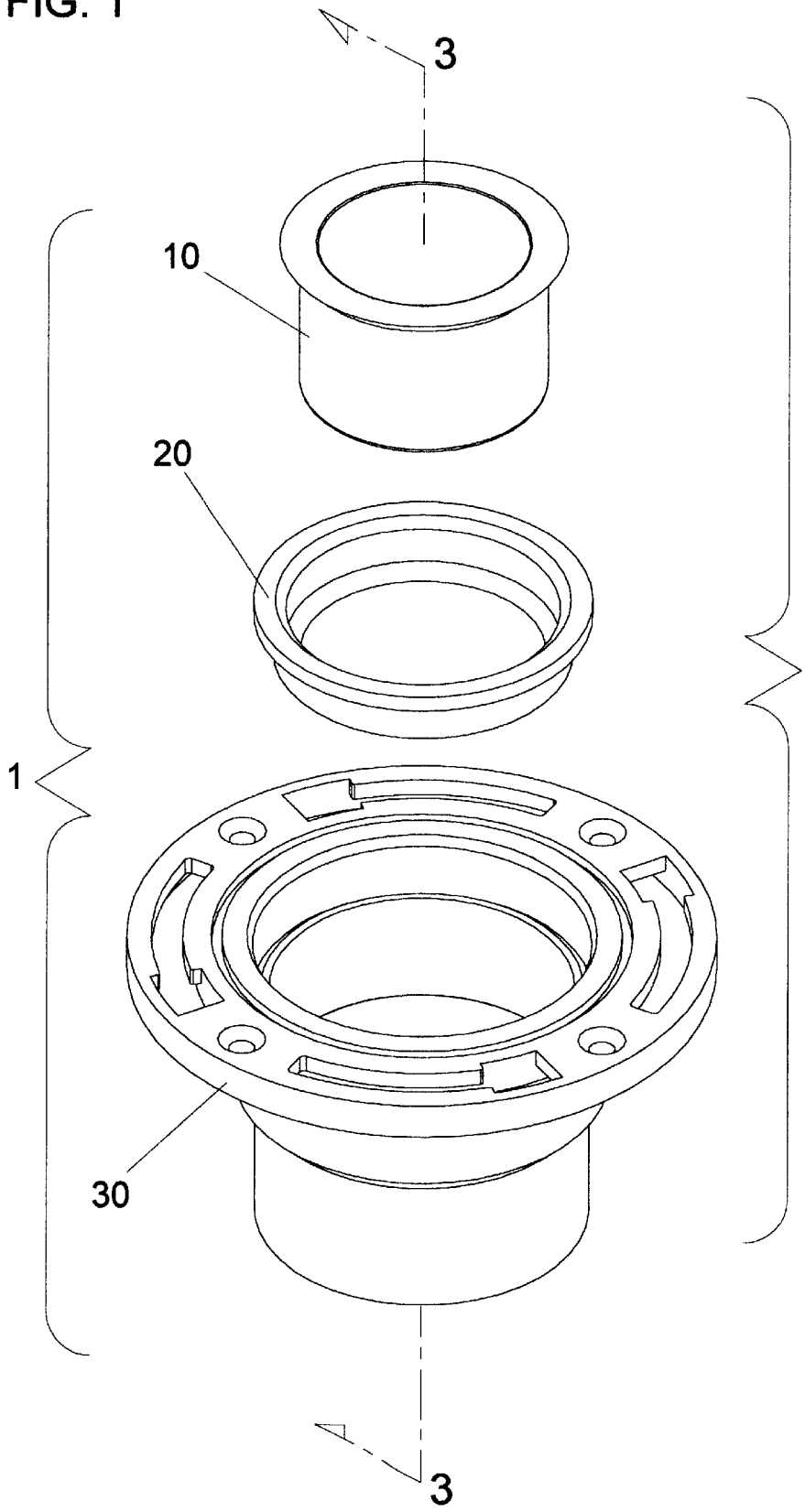
FIG. 1 is an exploded view of the preferred embodiment of the present invention, a seal apparatus.
Figure 2:
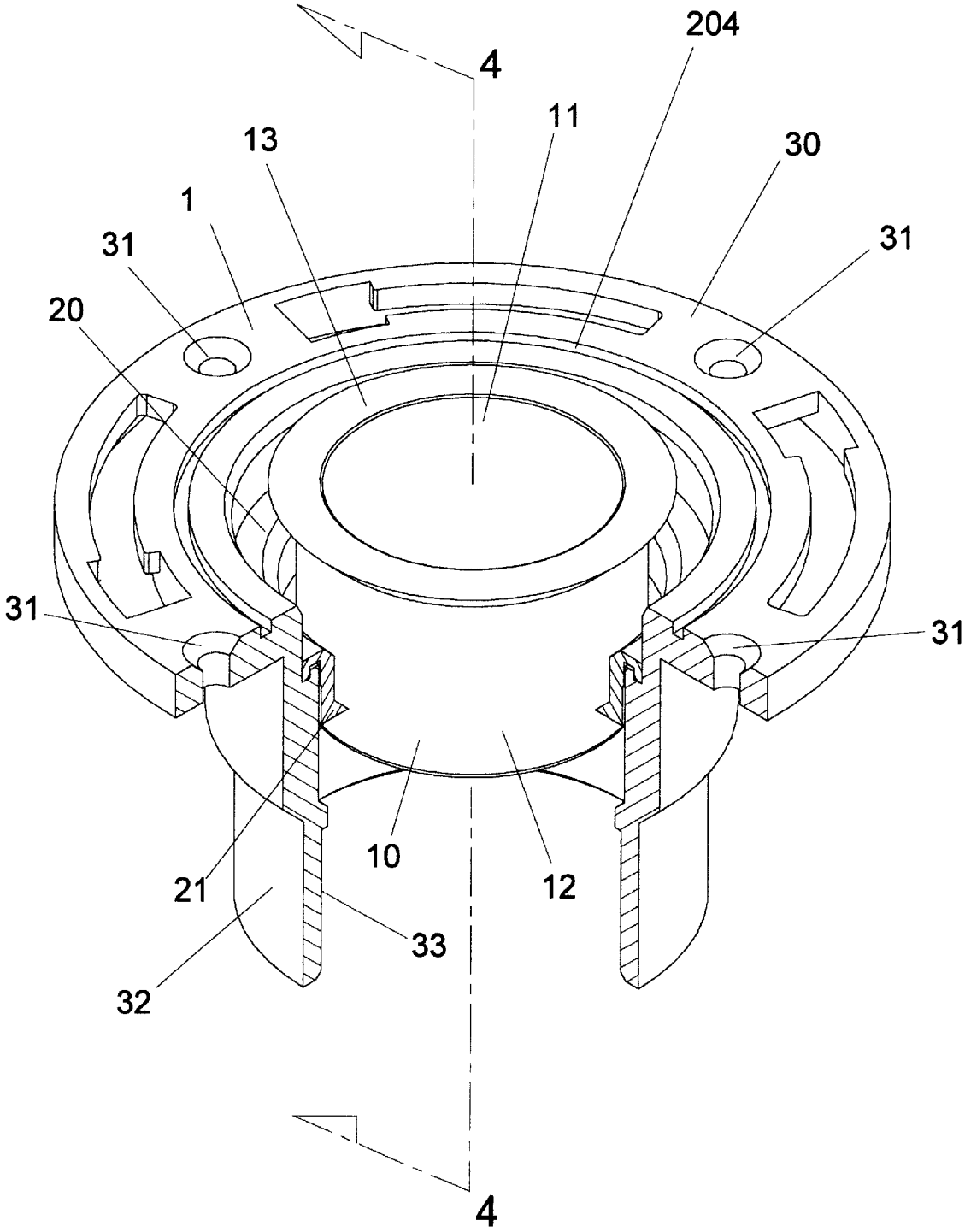
FIG. 2 illustrates the assembly of the seal apparatus.
Figure 4:
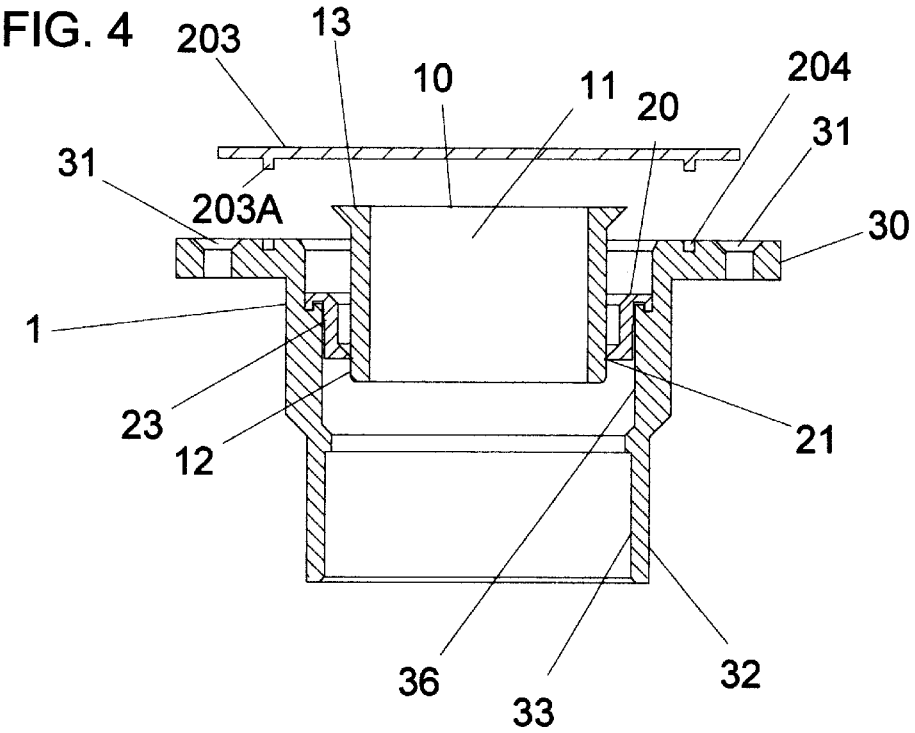
FIG. 4 is a cross section view of FIG. 2.

FIGS. 1, 2, 3, and 4 illustrate the preferred embodiment of the present invention, a seal apparatus 1 useful as a means of sealing a commode to a drain pipe, said seal apparatus 1 comprising a pipe extension 10, a gasket 20, a flanged base 30, and a cover plate 203 comprising an annular ring 203A.

The pipe extension 10 comprises a drain clearance 11, a pipe extension sealing surface 12, and a mounting face 13.

The gasket 20 comprises a sealing lip 21, a pipe extension clearance 22, a gasket sealing surface 23, and a tongue 24.

In the preferred embodiment, the gasket 20 is an annular gasket and the sealing lip 21 is an annular sealing lip.

The flanged base 30 comprises bolt clearances 31, inside pipe bonding surface 32, outside pipe bonding surface 33, a base drain 34, a stop ridge 35, a base sealing surface 36, a ledge 37, a groove 38, and a retainer groove 204.

The pipe extension sealing surface 12 is sealed by the sealing lip 21.

The tongue 24 fits around the ledge 37 and in the groove 38, effecting a seal between the gasket sealing surface 23 and the base sealing surface 36.

The tongue 24 fitting around the ledge 37 and in the groove 38 also serves to hold the gasket 20 in position with respect to the flanged base 30.

The annular ring 203A of the cover plate 203 engages the retainer groove 204 in the flanged base 30 when it is desired to close off the base drain 34. Closing off the base drain 34 of the flanged base 30, when the seal apparatus 1 is installed, prior to installing a commode is often desirable if there is going to be a waiting time prior to installing a commode. This prevents trash falling through the base drain 34 as well as sewer gases escaping up through the base drain 34.

Figure 5:
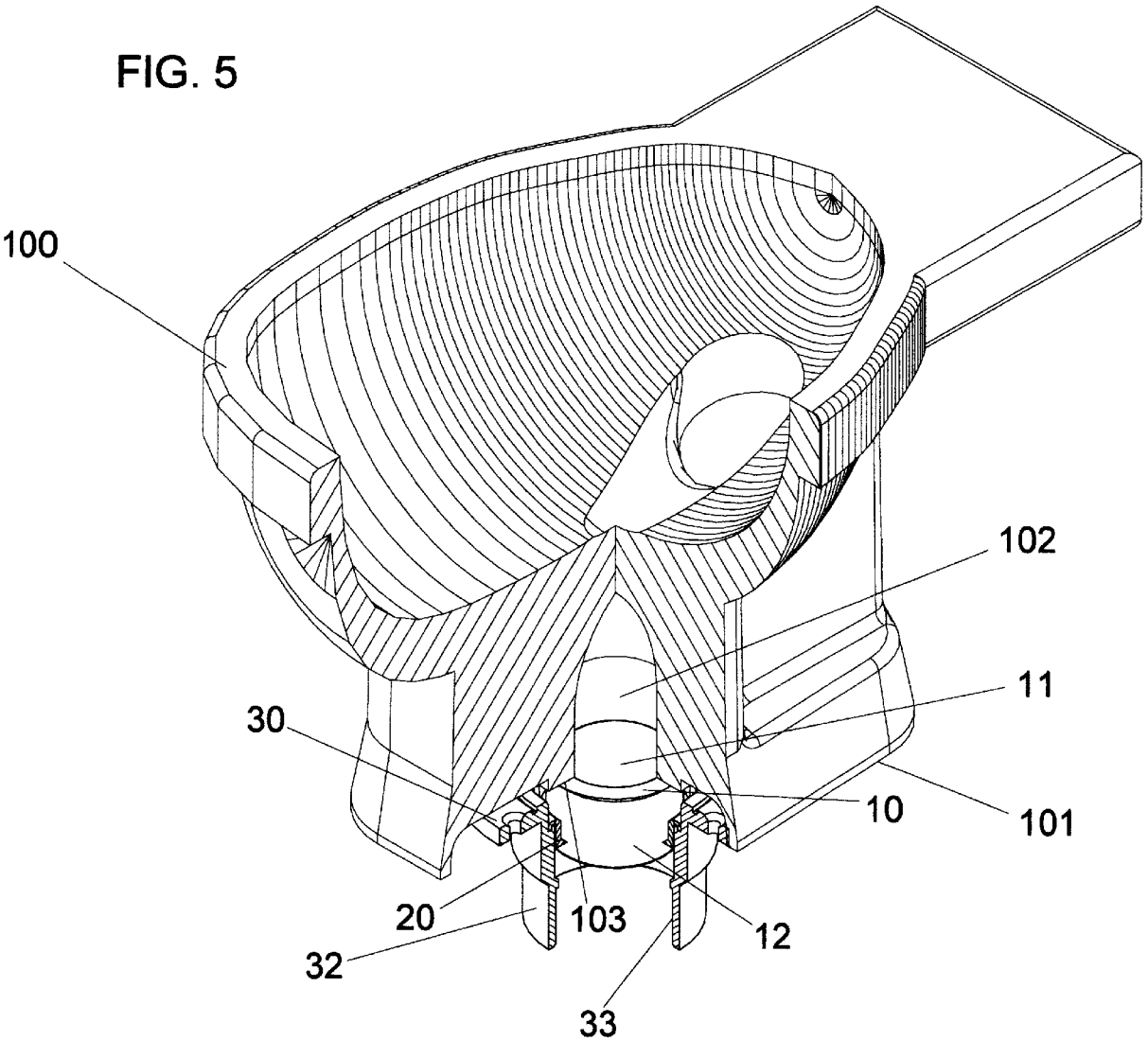
FIG. 5 illustrates the seal apparatus installed on a commode.

FIG. 5 illustrates a prior art commode 100 comprising a base 101, a fluid drain 102, and a fluid drain surface 103 with the seal apparatus 1, wherein, in the preferred embodiment, the pipe extension 10 with the drain clearance 11 and said sealing surface 12 is attached to said fluid drain surface 103, usually by an appropriate adhesive as a means to sealingly mate the pipe pipe extension 10 with the fluid drain 102 of said commode 100, at the fluid drain surface 103, and then said commode 100 with the pipe extension 10 is lowered so that the pipe extension 10 is inserted in the gasket 20, which is inserted in the flanged base 30 with said bonding surfaces 32 and 33.

Said pipe extension 10 is movable along the axis of said gasket 20.

Figure 6:
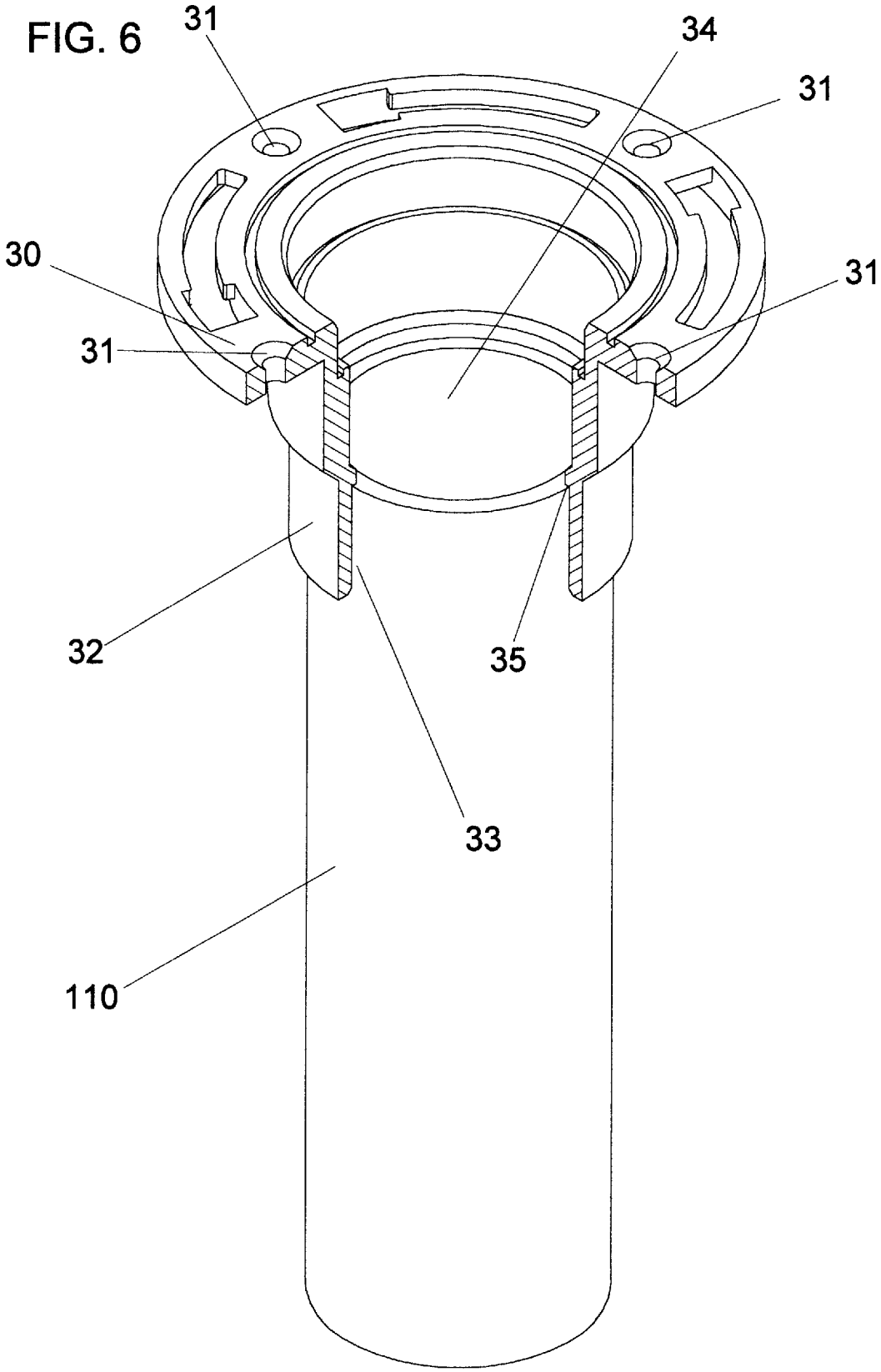
FIGS. 6 and 6A illustrate a flanged base installed over a drain pipe.
Figure 7:
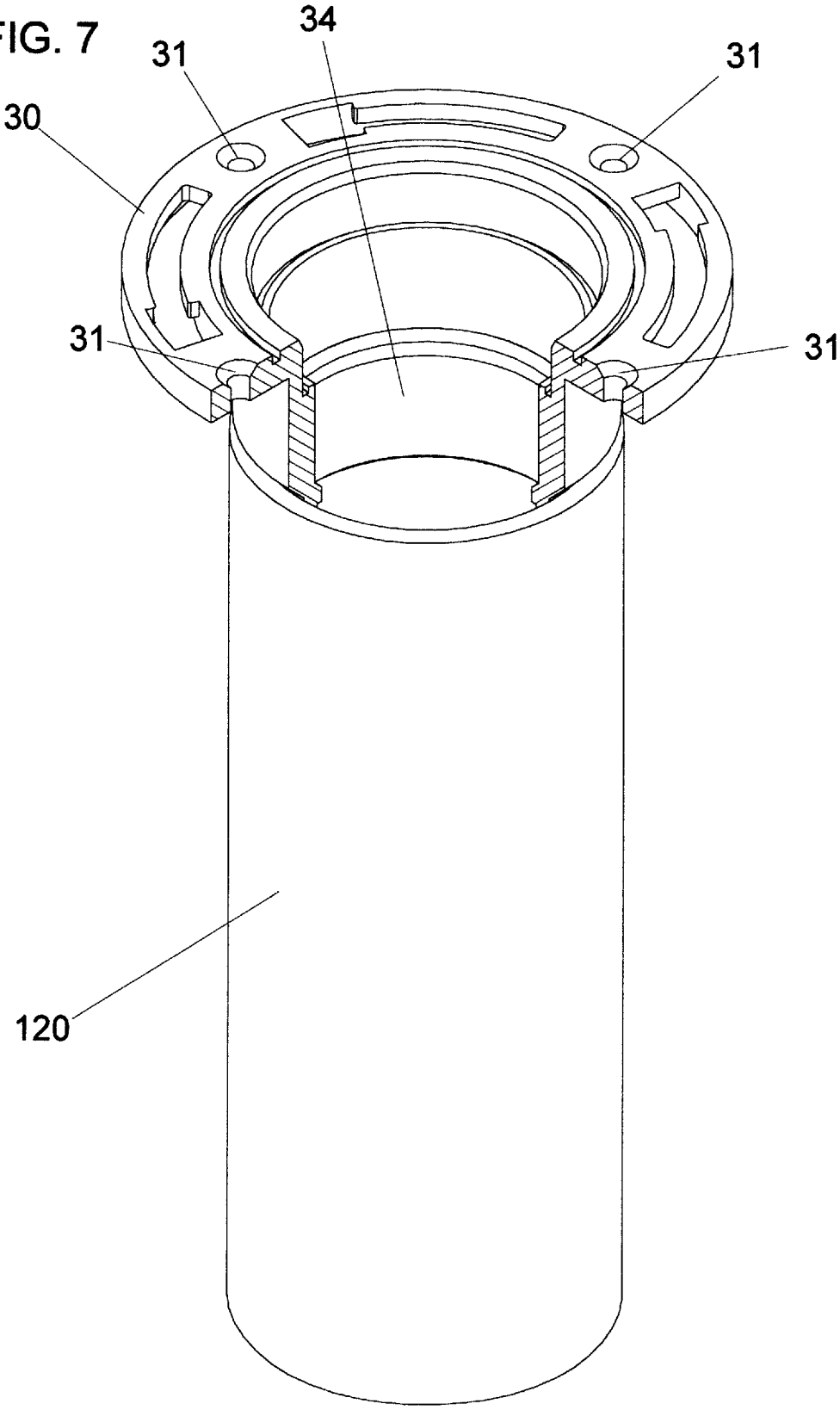
FIG. 7 illustrates the flanged base from FIG. 6 inserted into a larger diameter drain pipe than the drain pipe in FIG. 6.

FIGS. 6 and 7 illustrate the purpose and advantage of said bonding surfaces 32 and 33.

FIG. 6 illustrates the flanged base 30, with the base drain 34 and the bolt clearances 31, said base 30 inserted over, and, in the preferred embodiment, bonded to, a drain pipe 110.

Figure 6A:
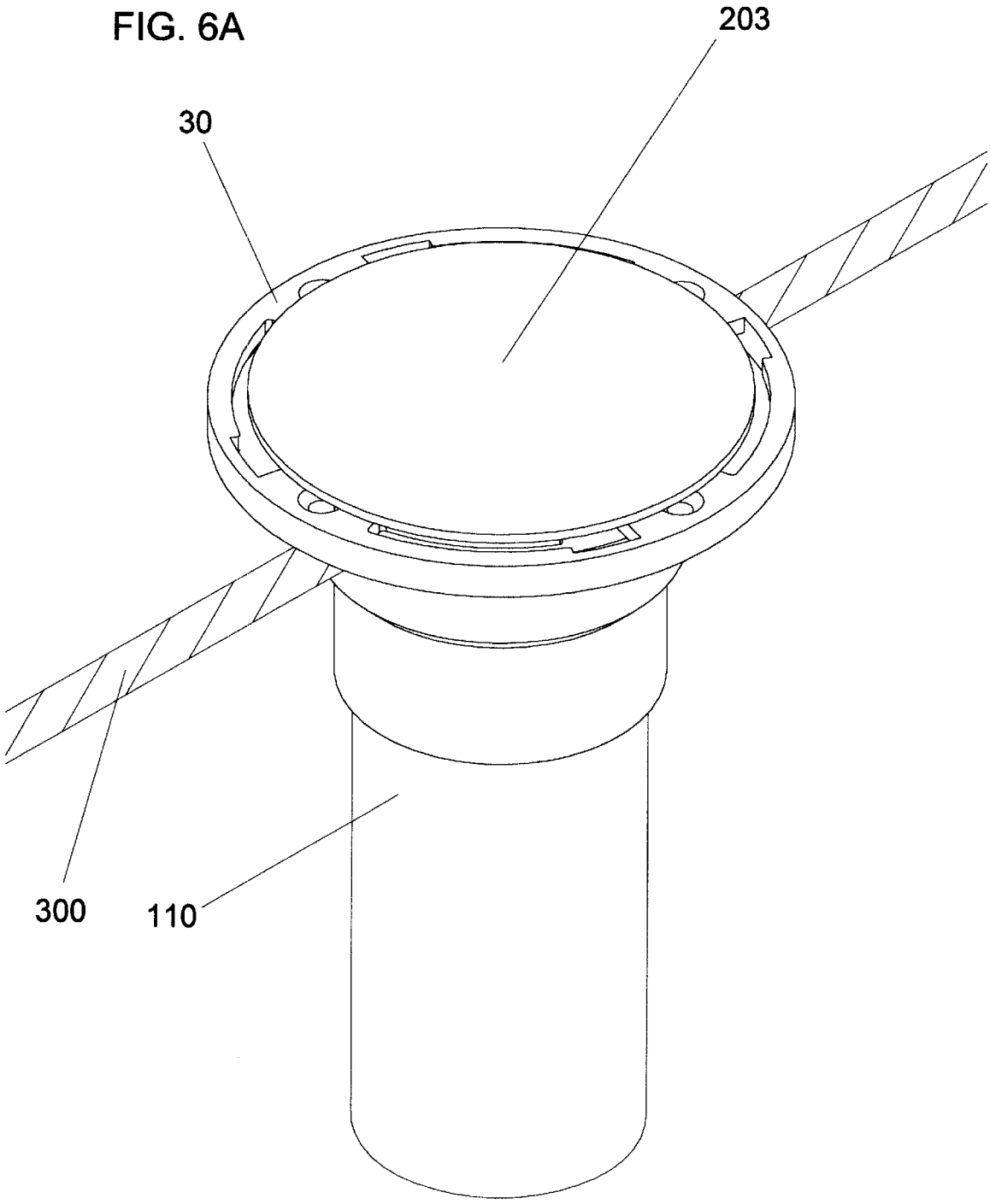

FIG. 6A illustrates the position of the drain pipe 110 with respect to a floor 300 with the cover plate 203 installed on the flanged base 30 to prevent trash from falling into the drain pipe 110.

FIG. 7 illustrated the flanged base 30 with the base drain 34 and the bolt clearances 31 inserted into, and, in the preferred embodiment, bonded to, an alternate drain pipe 120.

By having said bonding surfaces 32 and 33, one size of seal apparatus 1, is usable with more than one given size of a drain pipe. As a specific example, 3 inch and 4 inch schedule 40 drain pipes are common to the trade in the United States. The seal apparatus 1 can be sized to accommodate both sizes of drain pipes by sizing the inside bonding surface 32 to fit into, and be bondable, the inside diameter of a 4 inch schedule 40 alternate drain pipe 120 (Ref. FIG. 7) and by sizing the outside pipe bonding surface 33 to fit, and be bondable to, the outside diamater of a 3 inch diameter schedule 40 drain pipe 110 (Ref. FIG. 6). However, as obvious to anyone skilled in the art, the seal apparatus 1 is not restricted to only those sizes of drain pipes.

Typically, the flanged base 30, with the gasket 20 in place in the flanged base 30, is bonded, by a suitable adhesive, to a drain pipe such as said pipe 120 or 121, and secured to a floor by some mechanical means such as screws or bolts through the bolt clearances 31. Said commode 100, with the pipe extension 10 (Ref. FIG. 5) secured to said commode 100, is placed over the flanged base 1, inserting the pipe extension 10 into the gasket, 20, which serves as an annular seal, said pipe extension 10 sliding through said gasket 20, then lowering said commode 100 into position with the pipe extension 10 sliding through the gasket 20, thus enabling a watertight seal between said commode 100 and the fluid drain outlet surface 103 at the fluid drain 102 and said drain pipe 110 or 120.

Figure 3:
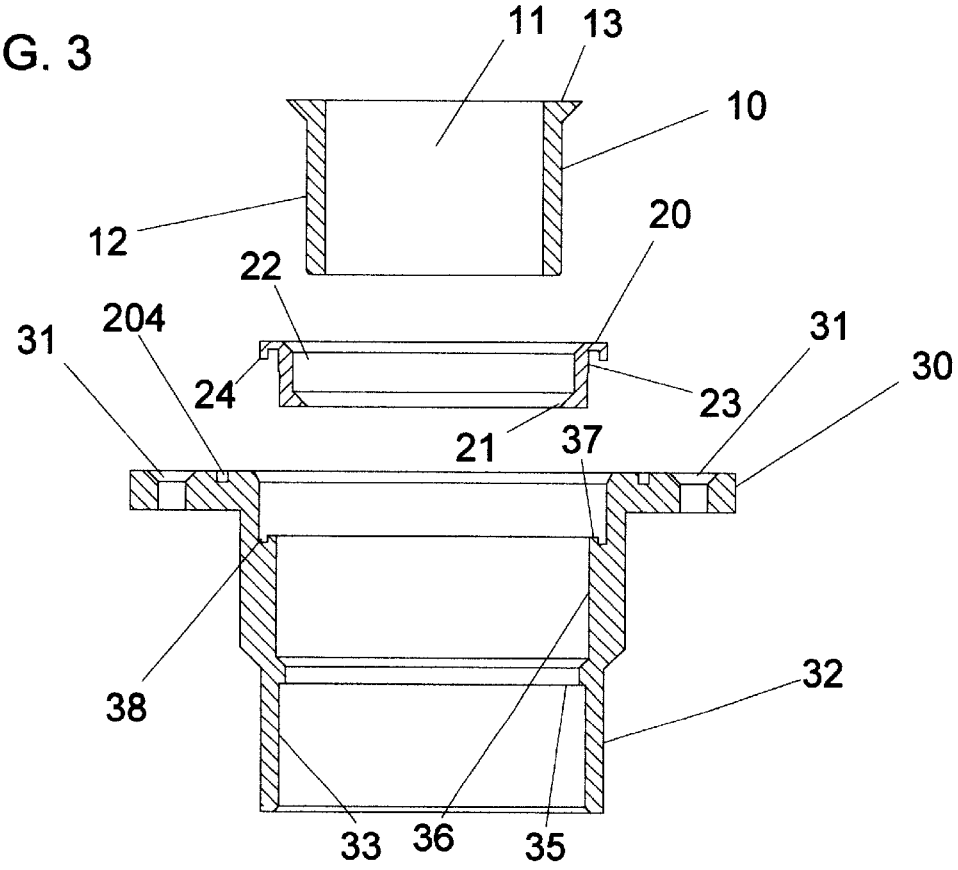
FIG. 3 is a cross section view of FIG. 1.

As can be seen in FIG. 3, the vertical position of the pipe extension 10 with respect to the gasket 20 is variable, to permit variations of heights of said commode 100 with respect to the gasket 20. This is an advantage over conventional wax ring seals for commodes.

With said pipe extension 10, carrying fluid discharged from said commode 100, sealingly mated with the fluid drain 102 at the fluid drain outlet 103 of said commode 100, and said pipe extension 10 sealed by said lip 21 of the gasket 20, said gasket 20 providing a seal between said flanged base 30 and said pipe extension 10, and with said flanged base 30 being sealingly attached to either of said drain pipes 110 or 120, a sealed flow path is formed from said commode 100 through to whichever of said drain pipes 110 or 120 is used.

Figure 8:
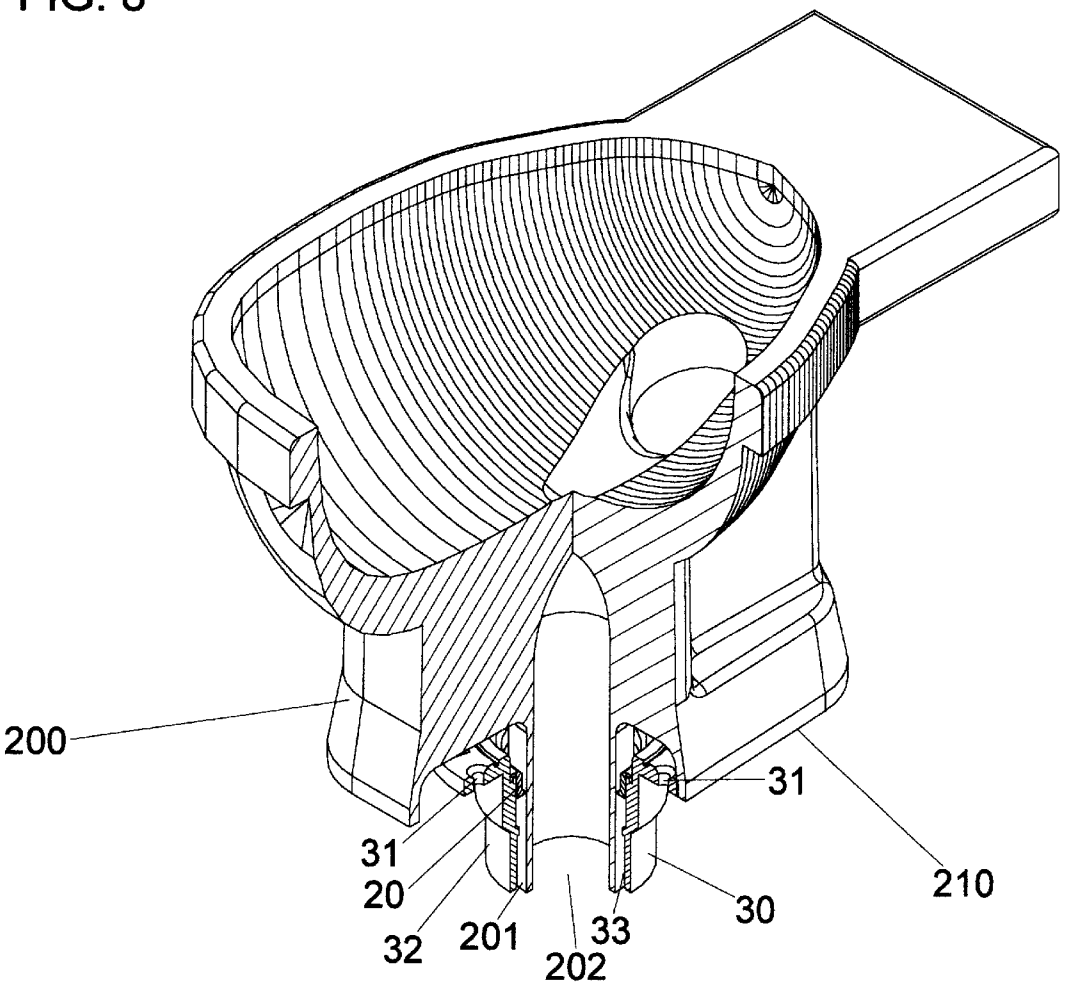
FIG. 8 illustrates an alternate embodiment seal apparatus with a commode with an integral pipe extension.
Figure 9:
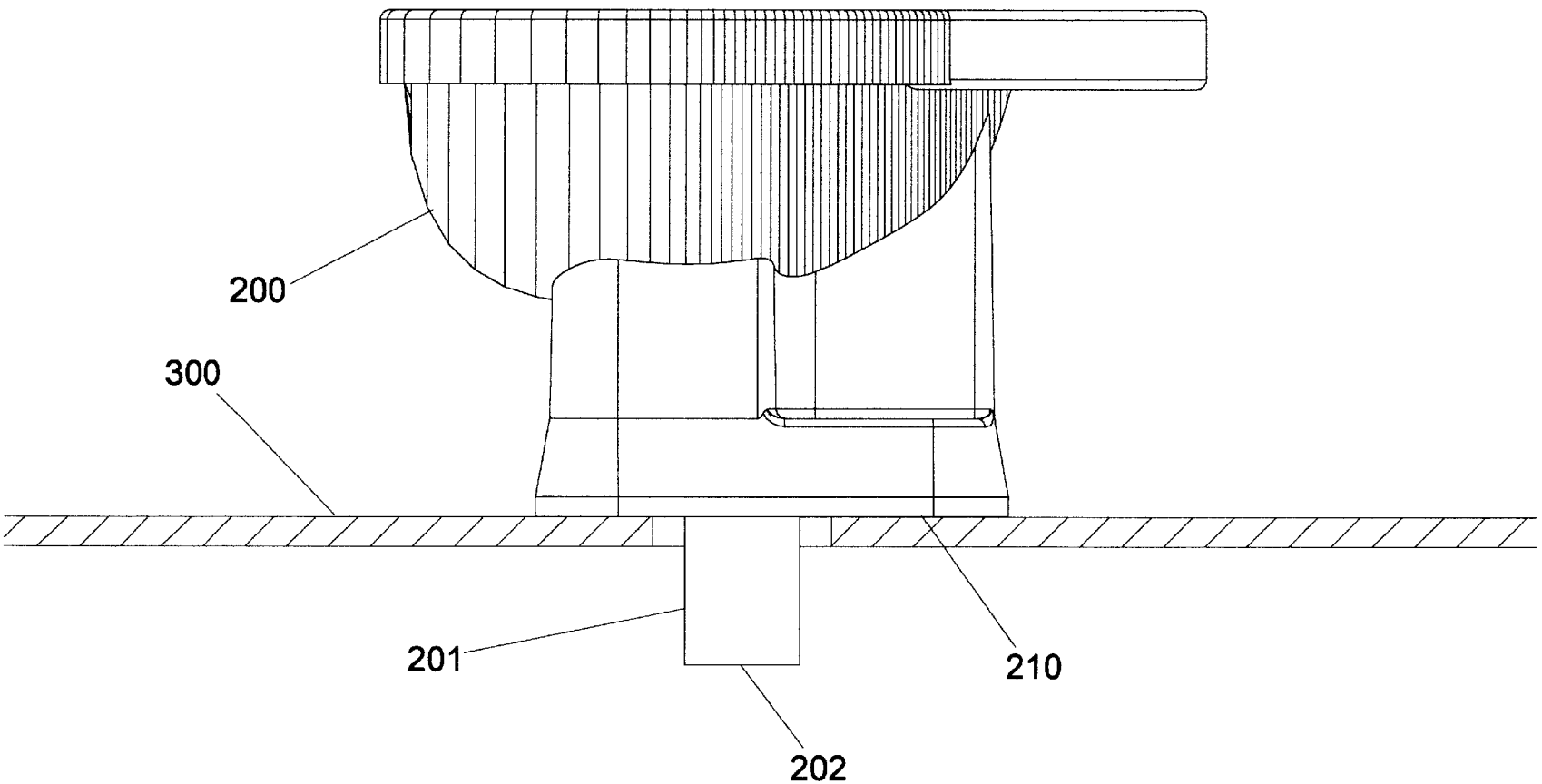
FIG. 9 illustrates the commode with an integral pipe extension from FIG. 8.

In an alternate embodiment of the present invention, as shown in FIGS. 8 and 9, an integral fluid outlet extension pipe 201 on an alternate commode 200, said commode 200 further comprising a drain exit 202 and a commode base 210, replaces the pipe extension 10 used with said commode 100 as shown in FIG. 5. The gasket 20 and the flanged base with the bolt clearances 31 and said bonding surfaces 32 and 33 serve as previously described in the seal apparatus 1. The embodiment of FIGS. 8 and 9 can be used with a traditional wax ring also.

FIG. 9 illustrates that the integral fluid outlet extension pipe 201 extends beyond said commode base 210 such that when said commode base is set on the floor 300 said integral fluid outlet extension pipe 210 extends below said floor 300.

In the prefered embodiment of the present invention, the material of construction for the pipe extension 10 and the flanged base 30 is an ABS plastic. However, as obvious to anyone skilled in the art, other materials may well serve the same purpose. However, ABS plastic, to an industry standard ABS B181.1 is known to and accepted in the trade. This material conforms to a Canadian CSA B191.1-99 standard. The gasket 20 is of a flexible polyvinyl chloride plastic. However, as obvious to anyone in the trade, other materials such as, but not restricted to, various blends of plastics or rubbers would serve the same purpose.

Although the description above contains many specificities, these should not be construed as limiting the scope of the invention but as merely providing illustrations of some of the presently preferred embodiments of this invention.

Thus the scope of the invention should be determined by the appended claims in the formal application and their legal equivalents, rather than by the examples given.

I claim:

1. A seal apparatus useful as a means of fluidly sealing a commode with a commode base to a drain pipe, said seal comprising:

a) a pipe extension section at said base of said commode carrying fluid discharged from said commode; and b) a flanged base comprising:

i) an annular gasket, said annular gasket including an annular sealing lip sized to fit against an exterior diameter of said pipe extension to form a sealing surface;

ii) an inside pipe bonding surface; and iii) an outside pipe bonding surface, such that said flanged base can be bonded to one of two different diameters of said pipes;

said pipe extension being movable along the axis of said annular gasket;

said flanged base being sealingly attached to said drain pipe such that a sealed flow path is formed from said commode through to said drain pipe.

2. A seal apparatus useful as a means of sealing a commode to a drain pipe, said seal apparatus comprising:

a) a pipe extension comprising:
a drain clearance,
an extension sealing surface, and
a mounting face;

b) a gasket comprising:
an annular sealing lip;
a pipe extension clearance, and
a gasket sealing surface; and c) a flanged base comprising:
a pipe bonding surface,
a base drain, and
a base sealing surface;

wherein said flanged base comprises an inside pipe bonding surface and an outside pipe bonding surface so that said flanged base can either be placed over, and be bondable to, or into, and be bondable to, a drain pipe, wherein with the gasket placed in said flanged base, wherein a commode with said pipe extension is placed on the flanged base with said pipe extension inserted into said gasket, wherein said base sealing surface is sealed by said annular sealing lip, thus enabling a seal between said commode and said drain pipe.

3. The seal apparatus of claim 2 wherein said inside pipe bonding surface is sized to fit inside, and be bondable to, a 4 inch diameter schedule 40 drain pipe, and wherein said outside pipe bonding surface is sized to fit over, and be bondable to, a 3 inch diameter schedule 40 drain pipe.

4. The seal apparatus of claim 2 wherein the vertical position of said pipe extension with respect to said gasket 20 is variable, thereby permitting variations of heights of said commode with respect to said gasket.

5. The seal apparatus of claim 2 wherein said pipe extension is an integral part of said commode.

6. A seal apparatus useful as a means of sealing a commode to a drain pipe, said seal apparatus comprising:

a) a pipe extension comprising:
a drain clearance,
an extension sealing surface, and
a mounting face;

b) a gasket comprising:
an annular sealing lip;
a tongue;
a pipe extension clearance, and
a gasket sealing surface; and c) a flanged base comprising:
a pipe bonding surface,
a ledge and a groove,
a base drain, and
a base sealing surface;

wherein said flanged base is bondable to a drain pipe, wherein with the gasket placed in said flanged base, wherein a commode with said pipe extension is placed on the flanged base with said pipe extension inserted into said gasket, wherein said tongue fits around said ledge and in said groove, effecting a seal between said gasket sealing surface and said base sealing surface, thus enabling a seal between said commode and said drain pipe.

7. The seal apparatus of claim 6 further comprising a cover plate comprising an annular ring, wherein said annular ring can be engaged into said groove, retaining said cover plate in position over the flanged base, closing said base drain.

8. A seal apparatus useful as a means of sealing a commode to a drain pipe, said seal apparatus comprising:

a) a pipe extension comprising:
a drain clearance,
an extension sealing surface, and
a mounting face;

b) a gasket comprising:
a pipe extension clearance, and
a gasket sealing surface; and c) a flanged base comprising:
a pipe bonding surface,
a base drain, and
a base sealing surface;

wherein said flanged base is bondable to a drain pipe, wherein with the gasket placed in said flanged base, wherein a commode with said pipe extension is placed on the flanged base with said pipe extension inserted into said gasket, wherein said gasket comprises a tongue, and wherein said flanged base comprises a ledge and a groove, wherein said tongue fits around said ledge and in said groove, effecting a seal between said gasket sealing surface and said base sealing surface.

* * * * *